US005386283A

United States Patent [19]

Yang et al.

[11] Patent Number: 5,386,283

[45] Date of Patent: Jan. 31, 1995

[54] APPARATUS TO FORM PICTURES FROM LARGE ORIGINALS

[75] Inventors: Bong won Yang; Myung Ho Noh, both of Seoul, Rep. of Korea

[73] Assignee: Hyundai Electronics Industries, Co., Ltd., Seoul, Rep. of Korea

[21] Appl. No.: 903,035

[22] Filed: Jun. 23, 1992

[30] Foreign Application Priority Data

Jun. 24, 1991 [KR] Rep. of Korea ..... 91-10517

[51] Int. Cl.[6] ..... G03G 21/00

[52] U.S. Cl. ..... 355/308; 355/48; 355/50; 355/200; 355/233; 355/310; 355/311

[58] Field of Search ..... 355/309, 308, 310, 311, 355/315, 28, 29, 48, 50, 233, 235, 215, 200; 346/134, 140 R; 226/198; 271/3.1

[56] References Cited

U.S. PATENT DOCUMENTS

| | | | |
|---|---|---|---|
| 3,332,328 | 7/1967 | Roth, Jr. | 355/215 X |
| 3,997,093 | 12/1976 | Aizawa et al. | 226/198 X |
| 4,046,470 | 9/1977 | Yamamoto | 355/310 |
| 4,105,330 | 8/1978 | Hilton | 355/102 |
| 4,273,438 | 6/1981 | Nishikawa | 355/272 |
| 4,385,825 | 5/1983 | Kaneko | 355/319 |
| 4,466,730 | 8/1984 | Jugle | 355/215 |
| 4,586,812 | 5/1986 | Kaneko et al. | 355/24 |
| 4,619,517 | 10/1986 | Ruhland | 355/259 |
| 4,690,540 | 9/1987 | Manno | 355/253 |
| 5,031,003 | 7/1991 | Hamano | 355/309 X |
| 5,072,306 | 12/1991 | Matsumoto et al. | 355/311 X |
| 5,172,238 | 12/1992 | Kuboki | 346/134 X |

FOREIGN PATENT DOCUMENTS

| | | |
|---|---|---|
| 57-193878 | 11/1982 | Japan . |
| 59-96955 | 6/1984 | Japan . |

*Primary Examiner*—A. T. Grimley
*Assistant Examiner*—Shak Y. Lee
*Attorney, Agent, or Firm*—Pennie & Edmonds

[57] ABSTRACT

The present invention is a type of office automation machine that is capable of copying a large size drawing by using an electronic photo method. The invention is designed to provide general printing function, a standard copying function, and a function of copying large size manuscripts such as design drawings. These functions are made possible by using a continuous printing paper in a reel form and by severing and discharging print output by an appropriate length. The printing paper is designed to refilled by a removable cassette. The transporting blades orbitally rotate to retrieve the developing agent from its container, so that the copying machine can be used efficiently and economically.

6 Claims, 4 Drawing Sheets

APPARATUS TO FORM PICTURES FROM LARGE ORIGINALS

FIELD OF THE INVENTION

The present invention relates to an office automation machine. It is a picture forming apparatus that prints and discharges multiple sheets of pictures in a short time using an electronic photo method. The machine, by using an optical projection device, is designed to scan computer-generated graphic information (eg., via word processor). The machine is capable of reading a standard size paper as well as a non-standard, larger size paper. It is capable of copying and printing large design drawings by printing the scanned image on a continuous roll of printing paper. The machine is also capable of automatically cutting and discharging printed images at appropriate lengths.

PRIOR ART

Various constructions of art picture forming devices have been introduced in the past. These devices, however, have been limited to providing standard copying operations.

In general, a manuscript copying apparatus employing the electronic photo method is constructed as shown in FIG. 1 and is described below.

The side of a paper containing the desired information is placed on top of the manuscript die 2, which is a uniform cabinet of transparent material. The die 2 is covered with similarly sized plate 3 to reflect light around the manuscript.

Under the manuscript die 2, a movable light source 4 is installed to read the information side of the manuscript. Additionally, a reflecting mirror 5*a* is installed to reflect image as generated by the movable light source 4. The reverse image corresponding to the printed information, as obtained by radiating the movable light source 4, is passed through a series of reflecting mirrors 5*a*, 5*b*, 5*c* and through a zooming device 12 onto the surface of photosensitive light receiving body 6.

On the one side of the photosensitive light receiving body 6, an optical system 14 is provided to be used as a printing device, and on the other side, developer 8, containing Chinese ink, is provided so that the light scanned by the optical system 14 is reflected by a mirror 15. Optical information, corresponding to the printed picture information, is then written on the surface of the photosensitive light receiving body 6.

Prior to the aforesaid process, an electrostatic charge is generated on the surface of the image storing body by a charger 7. The charger is designed to electrically charge the surface of the photosensitive light receiving body 6 to a fixed level so that the surface of the image storing body has an appropriate amount of potential.

When the photosensitive light receiving body 6 is in this state, and an optical signal equivalent to the printed image is scanned onto the surface of the photosensitive light receiving body 6, so that the portions corresponding to the image and the remaining portions receive the light, a potential difference is generated with respect to the image. This is due to the characteristics of the photosensitive light receiving body having the photosensitive characteristics (this is known as an electrostatic latent image).

The developing agent (Chinese ink) in 8 is then transferred from the developing cylinder 9 to the surface of the photosensitive light receiving body 6 by the electrostatic force generated from the potential difference. The ink is attracted only where the optical information is written.

At the same time, a sheet of printing paper is picked up by a pickup roller 18 housed in the paper cassette 17 and moved to the surface of the photosensitive light receiving body 6 by a register roller 19. The photosensitive light receiving body 6 starts rotation together with the pickup roller 18. The developing image is transferred from the surface of the photosensitive light receiving body 6 to the paper by an image transferring device 10 according to the same principle as the charger 7. The charger 7 is positioned below the buckle where the developing agent and the printing paper meet. Once the ink is transferred onto the printing paper, the developed image is captured by a fixing device 16 using heat and pressure.

Meanwhile, debris of the developing agent remaining on the surface of the photosensitive light receiving body 6 is removed while passing through a cleaner 11. This procedure prepares the photosensitive light receiving body 6 for a new printing process as initiated by an electrical signal.

To date, the size of the transparent manuscript die 2 and the printing paper cassette such as 17 has been limited to the A3 size. Hence, a manuscript of the size beyond A3 cannot be copied by current commercial means. Copying operations of that nature have been handled exclusively by specialized shops so that wide requirements of users have not been readily met.

Additionally, image copying apparatuses capable of copying and printing the pictures of sizes beyond A3 have had variety of problems related to handling and operation because they occupy a large installation area.

SUMMARY OF THE PRESENT INVENTION

Consequently, a picture forming apparatus capable of copying and printing manuscripts of not only the A3 size but also of larger manuscripts such as A1 size requiring minimum installation area has been desired. To meet these requirements, it is preferable that the printing paper equivalent to A1 size is fed from a reel form and severed at an appropriate length according to the commanded electrical signal.

For an efficient implementation of the present invention, the only necessary requirement is to modify an existing art copying machine so as to allow a feeding apparatus of A1 size manuscript.

The present invention aims to provide image forming apparatus which fully satisfies various users' requirements for copying large manuscripts of A1 size as well as the standard size papers. The machine achieves this goal by providing a manuscript reading mechanism and paper feeding apparatus that accommodate non-standard size manuscripts. As a part of this process, the machine also provides paper feeding and cutting operations from a roller feeding apparatus. In addition, this invention widens the range of copy machine usage by combining the printing process with the plotting function.

The foregoing and other objects, features and advantages of the invention will become apparent from the following detailed description and the accompanying drawings.

A BRIEF DESCRIPTION OF THE DRAWING

Figure 1:
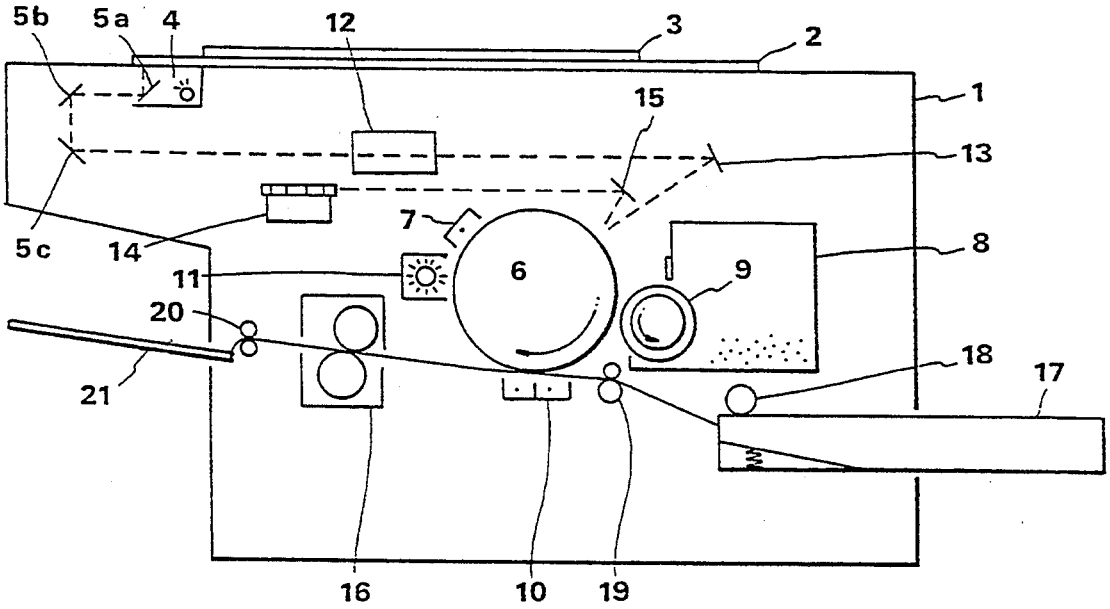
FIG. 1 PRIOR ART
FIG. 1 is a section view showing the interior construction of an old art manuscript copying machine.
Figure 2:
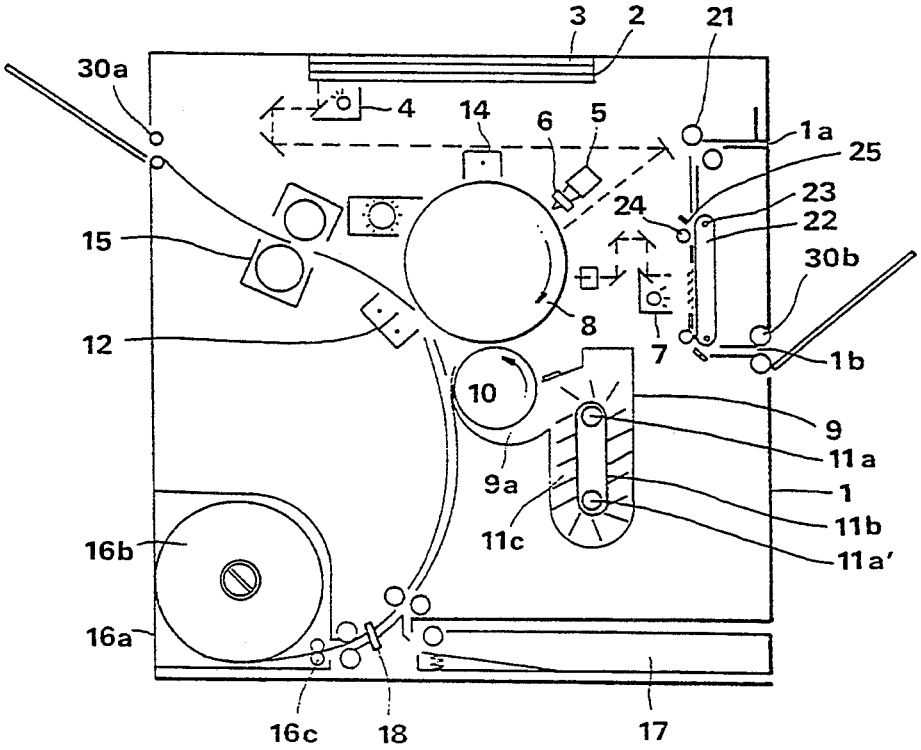
FIG. 2 is a section view showing the interior construction of the present invention.
Figure 3:
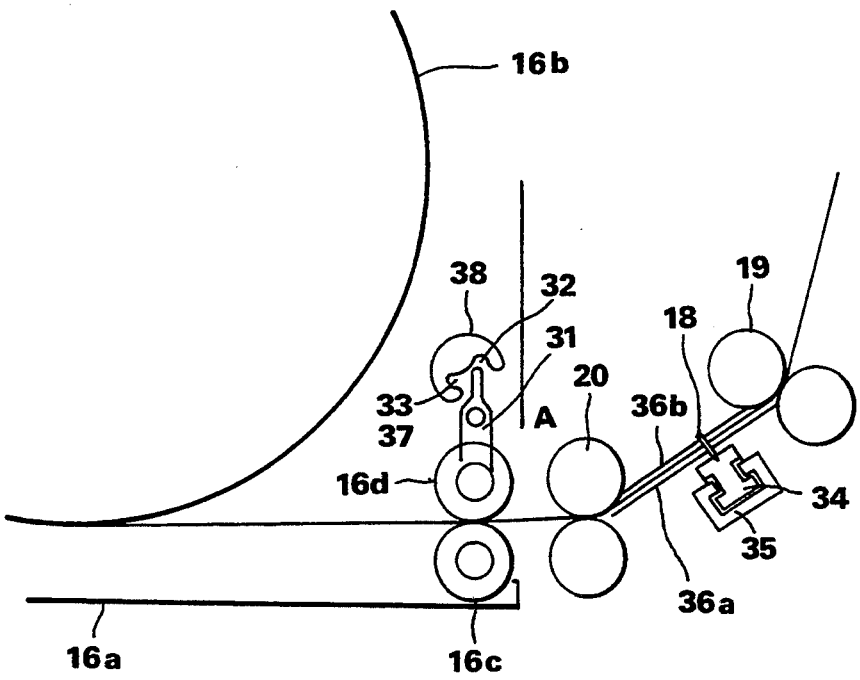
FIG. 3 is a partial enlarged view of the roll type printing paper supply and cutting section of the present invention.
Figure 4:
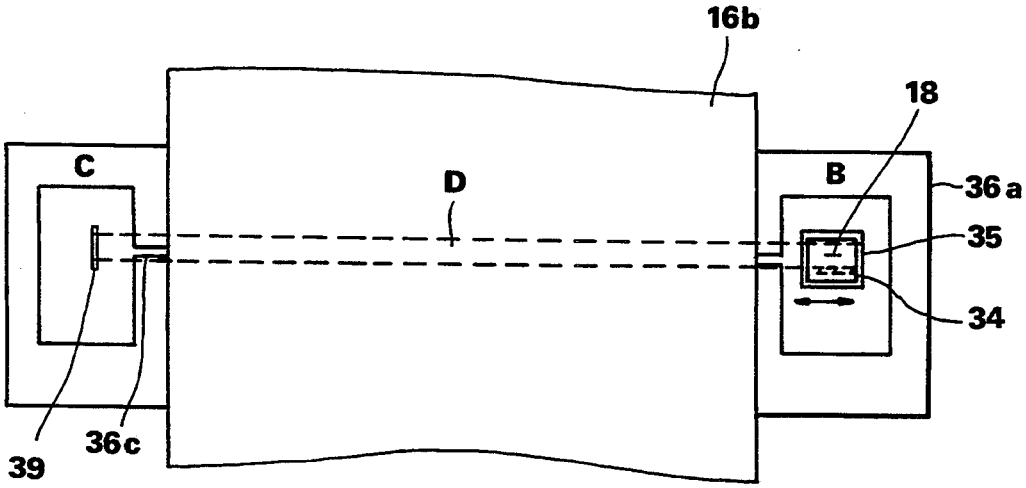
FIG. 4 is plan view of the cutting section of the present invention.
Figure 5:
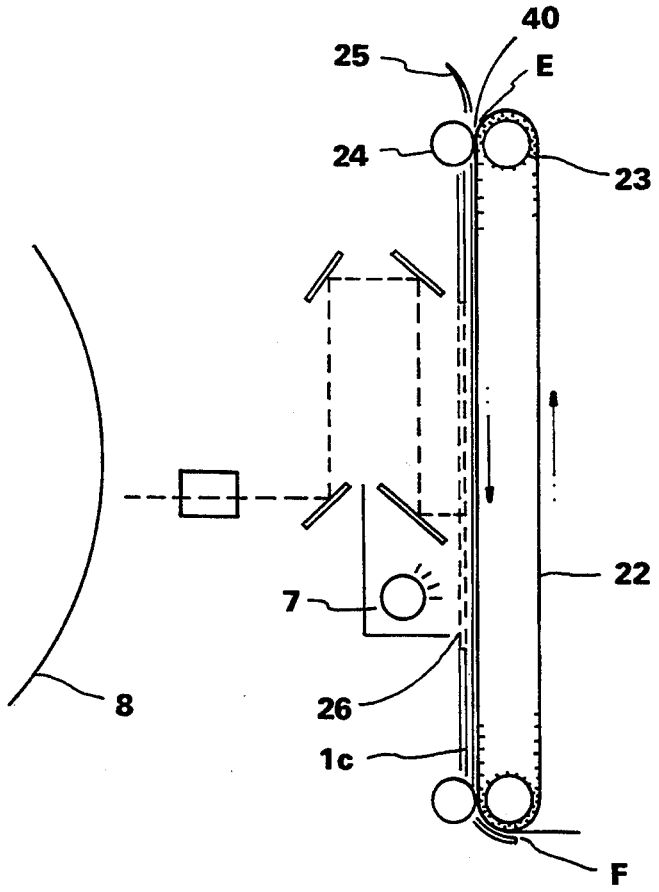
Figure 5:
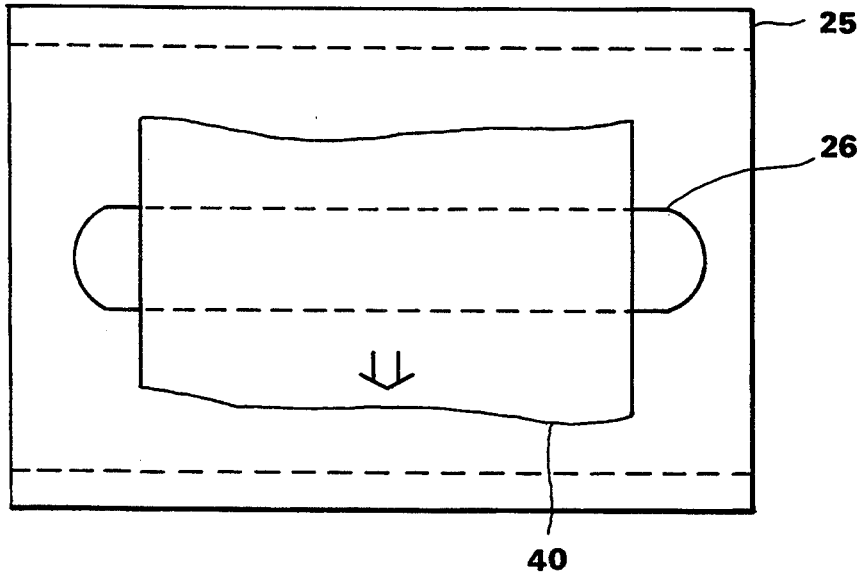

FIG. 5A and B are size views showing the installation state of a large size manuscript transferring section and reading section and a partial front view of a manuscript reading guide respectively of a present invention.

Figure 6:
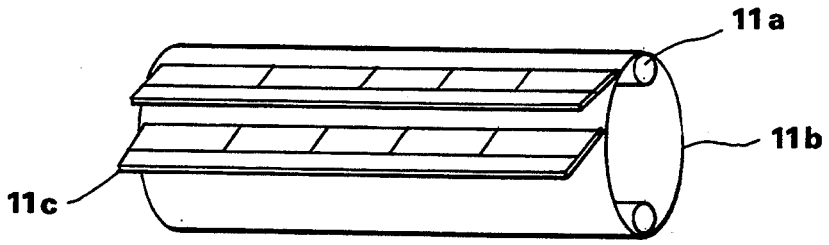

FIG. 6 is a partial perspective view of a developing agent transferring guide of developing section of the present invention.

Figure 7:
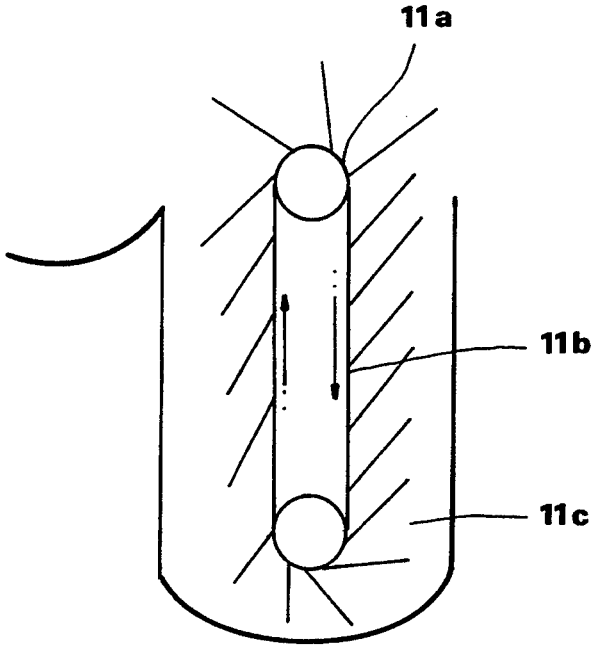

FIG. 7 shows the installation state of the developing agent transferring guide of the present invention.

DETAILED DESCRIPTION OF THE INVENTION

The preferred embodiment of the present invention may be described with reference to the following drawings:

The copy machine comprises of a transparent manuscript die 2 and a reflecting plate 3 fixed on the surface of a cabinet. The light source section 4 provides scanning of a manuscript by using light source and a reflecting mirror that creates horizontal reciprocal movement of the image under the transparent manuscript die 2. The reflecting image is perpetuated through several reflecting mirrors onto the surface of a photosensitive light receiving body 8. The developing section then applies ink onto the photosensitive light receiving body 8 and the fixing section fixes the developing agent transferring guide. Next, the fixing section fixes the developing agent on a printing paper exactly as scanned from the original image and the printed paper is then dispensed out of the cabinet.

The manuscript feeding path 1*c* provides an opening 26 for reading the manuscript as it passes through the feed path 1*c*. A fixed light source section 7 and a series of reflecting mirrors are designed to transfer the manuscript content toward the opening of the photosensitive light receiving body 8.

The pickup roller 21 and the discharge roller for feeding the manuscript are built inside the feed path 1*c* which guides and transfers input manuscript. For example, a large size manuscript enters the machine through the inlet port, passes through the feeding path 1*c* via the discharge roller 30*b*. As the manuscript passes through the feeding path 1*c*, the information of the manuscript is read by the fixed light source section 7 at the opening 26 and the read information is sent to the photosensitive light receiving body via the reflecting mirrors.

A register roller 24 for feeding the manuscript, a driving roller 23 for orbital rotation of auxiliary reflection protecting plate 22, and a guide 25 for proper feeding of the manuscript are installed in the feeding path 1*c*.

Since a large size printing paper is necessary for printing a large image 40, printing paper wound on a bobbin in reeled form is selected to reduce the volume, area and the handling radius. Additionally, a cassette 16*a* is used to facilitate the installation of the printing paper inside the cabinet. A cassette located on the lower part of the cabinet side allows for convenient installation and separation of the reeled printing paper.

A cassette 17 used for loading the printing paper of the size below A3 is installed facing the cassette 16*a*. The large size printing paper and the printing paper below A3 size share the use of register roller 19, and the large size printing paper 16*b* is supplied to the register roller 19 by a pickup roller 16*c* of the cassette 16*a*.

During the feeding of a large, non-standard size manuscript, the paper is severed when the original manuscript is copied to its length.

In order to cut the printing paper, it must be adequately stretched to tension. Another register roller 20 is installed to hold the printing paper between the register roller 19 and the roller 16*c* of the cassette 16*a*. The paper cutting blade 18 is placed between the register rollers 19, 20.

The cutting section 81 consists of upper and lower printing paper guides 36, 36*b*, forming the cutting blade recess 36*c* in the paper feeding path, a cutting blade 18 reciprocating along the cutting blade recess 36*c* of the guide rail 35 by a linear motor, and a slider 34 coupled with the cutting blade 18 and housed in the guide rail 35.

When either a large size printing paper 16*c* or a standard size paper 17 is fed to the photosensitive light receiving body 80 by the register roller 19, the developing agent on the surface of the photosensitive light receiving body 8 is transferred to the surface of the printing paper. When the paper passes through the image transferring device 12, the developing agent is then deposited on its surface. In order to reduce contamination of the machine interior by the dry ink debris during its refill and to reduce the frequency of refill itself, a large size developing agent container is provided 9.

The developing agent container is made up of cylinder 10 at the discharge opening 9*a*, a driving roller 11*a*, and a follower roller. A belt 11*b* is latched onto the teeth of the roller to provide tension and moves in an orbit inside the container 9. The surface of the belt is made up of inclined blades which are designed to transport the developing agent to the cylinder 10 at the rate of consumption.

The present invention is capable of copying originals of a size greater than A3. A user may select either the transparent manuscript die 2 or the manuscript inlet port la, provided at the side of the cabinet, for a large size printing work.

When the size of the manuscript is below A3, the manuscript should be placed on the transparent manuscript die 2 and a start button is pressed to perform the copying operation. If the manuscript is above A3 size, the front end of the manuscript should be inserted into the inlet port 1*a*.

The copying operation below A3 size is same as that using existing machine, hence, further explanation is omitted.

When a large size manuscript 40 is inserted into the inlet port 1*a*, the pickup roller 21 pulls the front end of the manuscript and transfers it to the feeding path 1*c*. As the manuscript passes through the opening 26 its content is read by the fixed light source 7 and is transferred onto the surface of the photosensitive light receiving body 8 via the reflecting mirrors.

Additionally, the content of the original is guided to the surface of the photosensitive light receiving body 8 through a lens 6 that is designed to emit light at the resolution capability of a picture input device 5.

The photosensitive light receiving body 8 with complete image transfer is then joined with the developing cylinder 10 enclosing the developing agent by a normal rotational driving device. The developing agent is then transferred to the area corresponding to the picture by electrostatic attraction.

At the same time, the register roller 19 is driven to pull the large size printing paper 16c to the photosensitive light receiving body 8. When the printing paper 16c passes through the image transferring device 12 the developing agent is transferred onto the printing paper 16c by the potential difference. The image of the original manuscript is then fixed onto the printing paper by the picture fixing device 15. The printing paper is subsequently discharged from the cabinet by a discharging roller 30a. The length of the large size manuscript is stored in memory as it passes through the feeding path 1c. The printing paper is discharged by the same length and at that instant the driving of the register rollers 19, 20 is stopped by an electric signal to restrain the transfer of the printing paper. Also at this time, the linear motor is driven to move the slider along the guide rail 35, and the cutting blade 18 passes through the cutting blade recess 36c of the paper feeding guide 36a, 36b at high speed to sever the printing paper 16b.

The completion of the cutting blade 18 motion is detected by a position sensor 39. Once detected, the pickup rollers 16c, 16d and the register rollers 19, 20 are also restrained and the end of the printing paper is pulled to a stop at the position of the cutting blade recess 36c. Finally, the cutting blade 18 returns to the origin by the linear motor to complete the cutting of the printing paper.

The developing agent, while being transferred to the developing cylinder 10, is orbitally moved by the vertically installed driving roller 11a and belt 11b. The inclined transporting blade 11c on the belt surface raises the developing agent by the necessary consumption amount and sequentially supplies the ink to the developing cylinder. Since the belt is in rotation, the developing agent can be raised from the bottom of the container. Also, in the event that the container 9 is full, the transporting blade 11c is allowed to release the ink to the inner wall by causing appropriate tension to the belt 11b. This action would also reduce the spin resistance of the belt.

When the large size printing paper is consumed, the printing paper cassette 16a is pulled out by exerting force and replaced by fixing printing paper onto a bobbin, and then installing it onto the cassette 16a. The upper roller 16b is then pulled in a direction "A", so that the end of the support, of the pickup roller rotates about a rotating axis 37. This action fixes the support end 31 to the horizontal fixing recess 33 of an opening device and allows separation between the pickup roller 16c and the upper roller 16d.

Under this condition, if the end of the printing paper is placed on the pickup roller 16c and the upper roller is pushed back to its original position, the end of the roller support 31 is forced to a vertical fixing recess 32. The roller support is fixed there so that the pickup roller 16c and the upper roller 16d are allowed to engage with each other, and the front end of the printing paper is clamped between the upper and lower printing paper guides 36a, 36b.

As described above, in the present invention, the range of copying is significantly improved by allowing copying of the large size manuscript. The machine is capable of copying images in a variety of sizes both below and above A3 size, by using a fixed light and photosensitive light receiving body and printing the image on printing paper wound on a reel. A variety of copying functions can be performed since the machine virtually alleviates size limitation of the original, and allowing each subunit to be used as a standard copying machine, a printer, a plotter, or a facsimile.

Note that the various changes to the invention may be made without departing from its spirit and scope.

What is claimed is:

1. A picture forming apparatus capable of printing picture images on paper comprising:

a normal picture image forming part comprising:

a transparent manuscript die on which the manuscript of size below A3 size may be placed, a movable light source section that reads a subject image, and a photosensitive light receiving body that transfers a developing agent according to the image to a printing apparatus; and a large picture image forming part comprising:

a large size manuscript feeding path consisting of a manuscript inlet port, a discharge port and a fixed light source section 7, a developing agent container section 9 that supplies developing agent to a developing cylinder by an orbital movement of transporting blades, a large size printing paper section in which the printing paper is continuously wound in a reel form, and a cutting section that cuts said printing paper to a proper length of the manuscript as it passes through said large size manuscript feeding path.

2. The picture forming apparatus as claimed in claim 1 wherein said large size image forming part further comprises a large size rolled printing paper installed inside a cabinet via a movable cassette bobbin.

3. The picture forming apparatus as claimed in claim 1 wherein said large size image forming part further comprises upper and lower printing paper guides with a cutting blade recess between register rollers, and a cutting blade slider installed below the guides.

4. The picture forming apparatus as claimed in claim 1 wherein said fixed light source section 7 is installed in the manuscript feeding path and reads the manuscript through an opening defined between a pickup roller at an upper side of the opening and a discharge roller at a lower side of said fixed light source section 7, and said fixed light source section 7 having an auxiliary reflection plate, a register roller, and a guide.

5. The picture forming apparatus as claimed in claim 1 wherein said developing agent container section 9 has driving rollers, a belt which performs an orbital motion inside the container section, and a transporting blade formed in an incline on a surface of the belt to transport the developing agent.

6. A picture forming apparatus as claimed in claim 1 or claim 3 wherein a position sensor is installed on printing paper guides to advance the printing paper length while printing and to stop the printing process by sensing the movement of a cutting blade.

* * * * *